US010813460B2

(12) United States Patent
Turner

(10) Patent No.: US 10,813,460 B2
(45) Date of Patent: Oct. 27, 2020

(54) CUSHION SYSTEM

(71) Applicant: Meldetress K. Turner, Wylie, TX (US)

(72) Inventor: Meldetress K. Turner, Wylie, TX (US)

( * ) Notice: Subject to any disclaimer, the term of this patent is extended or adjusted under 35 U.S.C. 154(b) by 158 days.

(21) Appl. No.: 16/101,373

(22) Filed: Aug. 10, 2018

(65) Prior Publication Data

US 2019/0045932 A1 Feb. 14, 2019

Related U.S. Application Data

(60) Provisional application No. 62/543,529, filed on Aug. 10, 2017.

(51) Int. Cl.

| | |
|---|---|
| ***A47C 7/02*** | (2006.01) |
| ***A61H 19/00*** | (2006.01) |
| ***A47C 27/15*** | (2006.01) |

(52) U.S. Cl.

CPC ..... *A47C 7/021* (2013.01); *A47C 27/15* (2013.01); *A61H 19/44* (2013.01); *A61H 19/40* (2013.01)

(58) Field of Classification Search

CPC ..... A47G 9/10; A47G 2009/1018; A47G 9/1045; A47G 9/0253; A47C 7/021; A47C 27/15; A47C 15/008; A47C 16/00; A47C 20/02; A61H 19/30; A61H 19/32; A61H 19/34; A61H 19/40; A61H 19/44; A61H 19/50

USPC ... 5/653, 652, 657, 630, 632, 636, 640, 490; 600/38

See application file for complete search history.

(56) References Cited

U.S. PATENT DOCUMENTS

| | | | | |
|---|---|---|---|---|
| 3,761,131 | A * | 9/1973 | Oliver | A47C 7/18 297/452.16 |
| 5,745,940 | A * | 5/1998 | Roberts | A47C 27/001 5/727 |
| 6,038,719 | A * | 3/2000 | Castagna | A47G 9/1045 5/636 |
| 7,770,248 | B2 * | 8/2010 | Furlow | A47C 7/425 5/640 |
| 7,993,262 | B2 * | 8/2011 | Cianfrani | A61H 19/34 600/38 |
| 8,015,641 | B2 * | 9/2011 | Furlow | A47C 7/425 5/632 |
| 9,204,720 | B2 * | 12/2015 | Gagnon | A47B 87/00 |
| 9,770,105 | B2 * | 9/2017 | Gagnon | A47C 15/008 |
| 10,251,808 | B1 * | 4/2019 | Theis | A61H 19/44 |
| 2007/0213772 | A1 * | 9/2007 | Cianfrani | A61H 19/34 607/2 |
| 2007/0214572 | A1 * | 9/2007 | Buben | A61H 19/00 5/630 |

(Continued)

*Primary Examiner* — Robert G Santos

(74) *Attorney, Agent, or Firm* — Abel Schillinger, LLP

(57) ABSTRACT

Systems and methods are disclosed that include providing a support cushion with a plurality of cushions, a cover, an aperture disposed through the cover and between the cushions, a bottom opening in the cover, and an attachment system. The cushion system attaches to a support apparatus for use thereon by receiving the support apparatus through the bottom opening and manipulating the attachment system to reduce the bottom opening to a size smaller than a perimeter of the support apparatus. An optional object may be secured to the support apparatus and extend between the plurality of cushions and through the aperture.

18 Claims, 6 Drawing Sheets

(56) References Cited

U.S. PATENT DOCUMENTS

| | | | | |
|---|---|---|---|---|
| 2008/0120786 | A1* | 5/2008 | Furlow | A47C 7/021<br>5/722 |
| 2010/0269261 | A1* | 10/2010 | Furlow | A47C 7/021<br>5/653 |
| 2011/0271454 | A1* | 11/2011 | Furlow | A47C 7/021<br>5/653 |
| 2013/0102842 | A1* | 4/2013 | Zwezdaryk | A47B 85/00<br>600/38 |
| 2016/0000223 | A1* | 1/2016 | Gagnon | A61H 19/44<br>600/38 |
| 2019/0045932 | A1* | 2/2019 | Turner | A47C 27/15 |

* cited by examiner

CUSHION SYSTEM

CROSS-REFERENCE TO RELATED APPLICATIONS

This application claims priority under 35 U.S.C. 119(e) to U.S. Provisional Patent Application No. 62/543,529 filed on Aug. 10, 2017 by Meldetress K. Turner, and entitled "Cushion System," the disclosure of which is hereby incorporated by reference in its entirety.

STATEMENT REGARDING FEDERALLY SPONSORED RESEARCH OR DEVELOPMENT

Not applicable.

BACKGROUND

Cushions and/or padded support systems are often used to provide support and/or enhance comfort in various applications, including but not limited to automobiles, furniture, sporting equipment, and transportable comfort devices. Additionally, in some applications, such cushions and/or padded support systems may also be used to provide ergonomic support, position a user in an appropriate and/or preferred position, and/or adapt otherwise uncomfortable items for use in a comfortable manner.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION

In this disclosure, reference may be made to the spatial relationships between various components and to the spatial orientation of various aspects of components as the devices are depicted in the attached drawings. However, as will be recognized by those skilled in the art after a complete reading of this disclosure, the devices, members, apparatuses, etc. described herein may be positioned in any desired orientation. Thus, the use of terms such as "above," "below," "upper," "lower," or other like terms to describe a spatial relationship between various components or to describe the spatial orientation of aspects of such components should be understood to describe a relative relationship between the components or a spatial orientation of aspects of such components, respectively, as the device described herein may be oriented in any desired direction.

Figure 1:
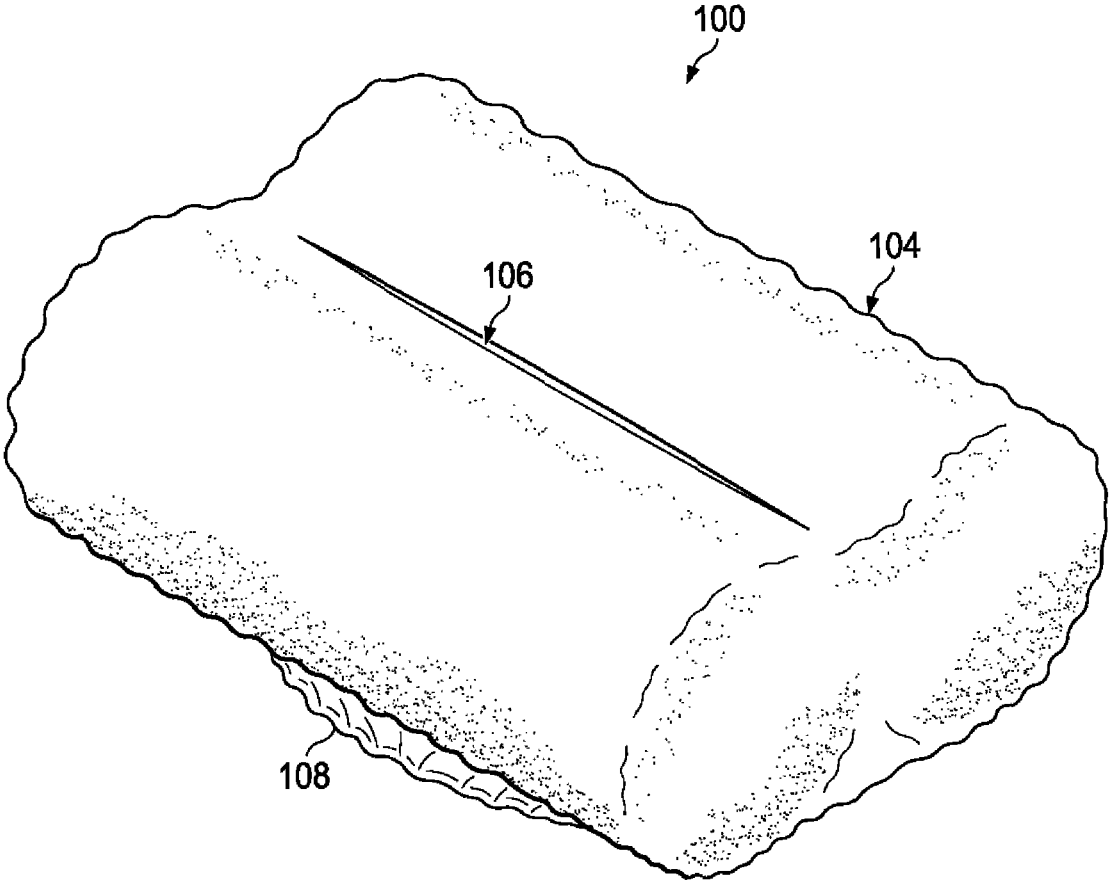
FIG. 1 is an oblique top view of a cushion system according to an embodiment of the disclosure.
Figure 2:
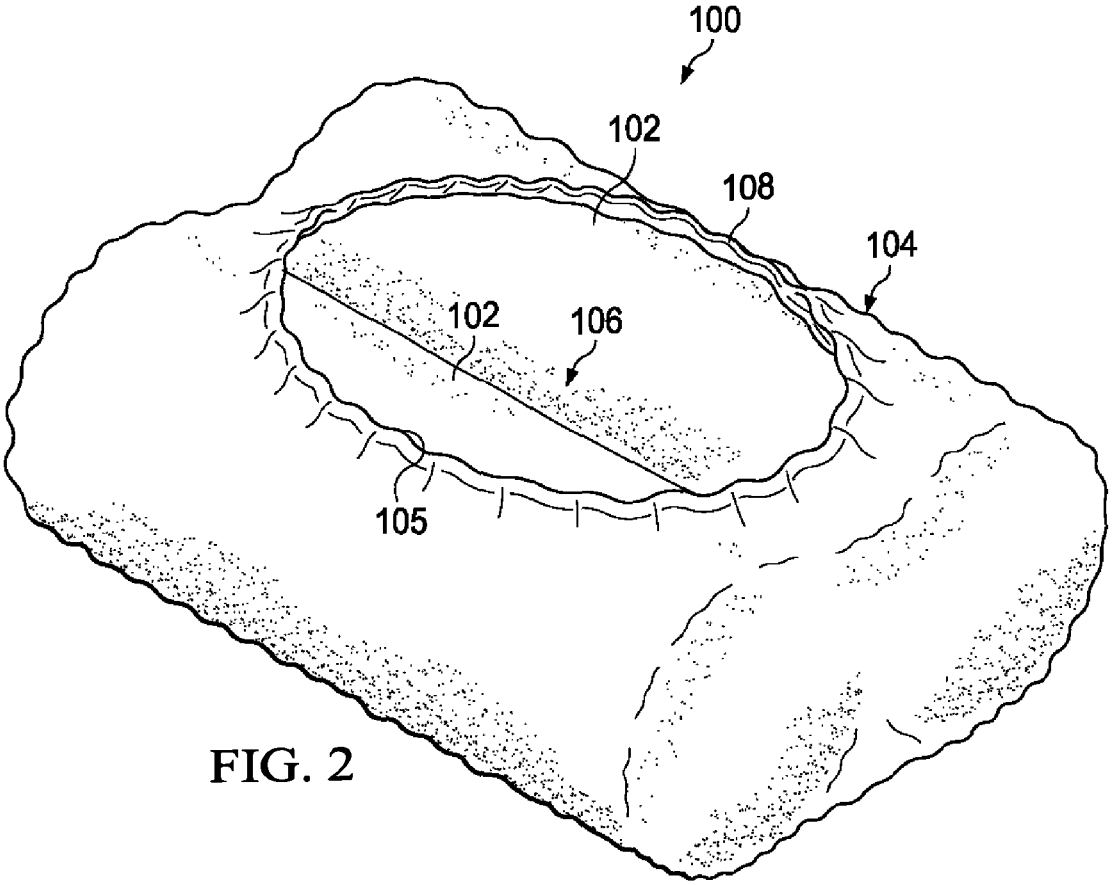
FIG. 2 is an oblique bottom view of the cushion system of FIG. 1 according to an embodiment of the disclosure.
Figure 3:
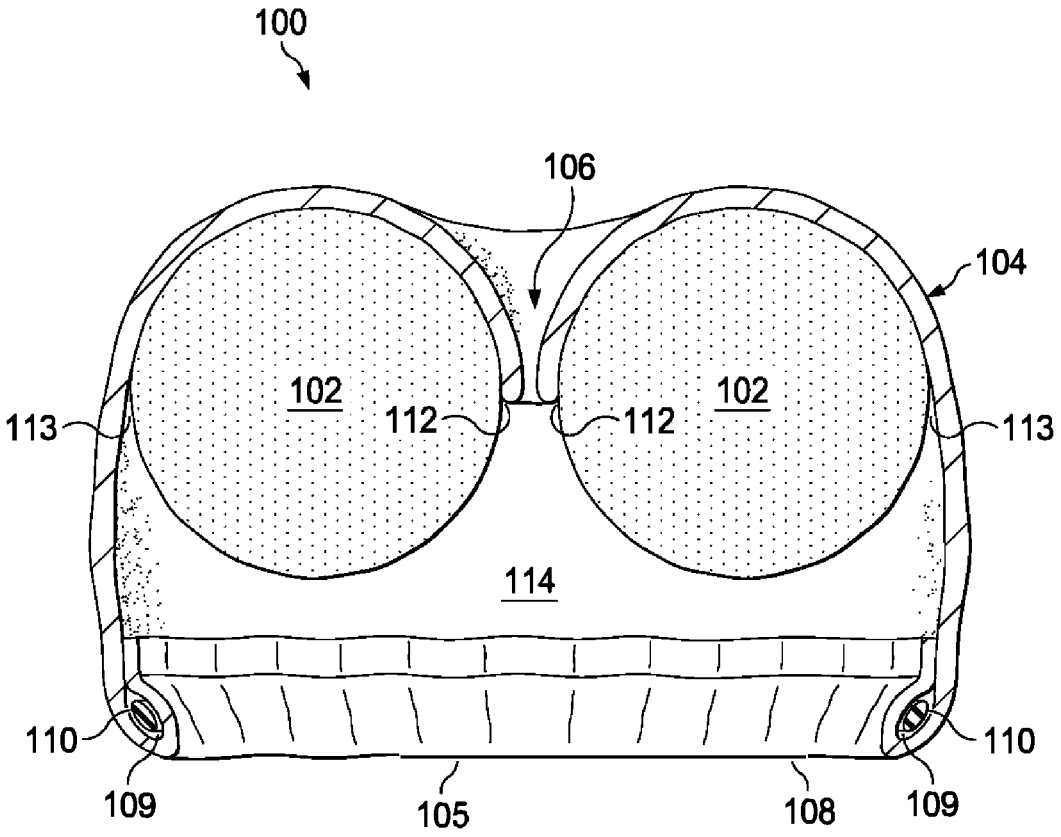
FIG. 3 is a cross-sectional view of the cushion system of FIGS. 1 and 2 according to an embodiment of the disclosure.

Referring now to FIGS. 1 through 3, an oblique top view, an oblique bottom view, and a cross-sectional view of a cushion system 100 are shown, respectively, according to an embodiment of the disclosure. The cushion system 100 generally comprises a plurality of pads or cushions 102 and a cover 104. In this embodiment, the cushion system 100 comprises two closely parallelly-arranged, cylindrically-shaped cushions 102. However, in other embodiments, the cushions 102 may comprise any elongated shape and be similarly parallelly-arranged. In yet other embodiments, the cushion system 100 may comprise only a single cushion 102 that form a circular, rectangular, triangular, and/or any other shape. The cushions 102 may generally comprise a plush outer surface. The cushions 102 may be formed from and/or filled with a soft, pliable material such as foam, polyester, feathers, down alternative material, memory foam, gel and/or a combination of any of the aforementioned materials.

The cover 104 may generally be formed from a soft, plush fabric and be integrated with the cushions 102. In some embodiments, the cover 104 may be integrated with the cushions 102 by sewing, stitching, adhering, and/or otherwise securing the cover 104 to the cushions 102. In some embodiments, the cover 104 may be attached at an inner seam 112 to an inner surface of the each of the cushions 102. However, in some embodiments, the inner seams 112 may be on a bottom portion, outer portion, and/or any other portion of the cushions 102. Additionally, it will be appreciated that the cover 104 may join and/or otherwise attach the cushions 102 at adjacently disposed ends of the inner surface of each cushion 102 to form an aperture 106 through the cover 104 and between the cushions 102. More specifically, it will be appreciated that the aperture 106 may extend through a top of the cover 104, between the parallelly-arranged cushions 102, and through a bottom opening 105 of the cover 104. Furthermore, in embodiments comprising a single cushion 102 formed in a circular, rectangular, triangular, and/or any other shape it will be appreciated that the aperture 106 may extend through a center opening of the single cushion 102.

In the embodiment shown comprising the closely parallelly-arranged cushions 102, the cushions 102 may be adjacently disposed, such that in a resting position with no force applied to the cover 104 and/or the cushions 102, the aperture 106 may remain substantially closed, such that the cover 104 at the opposing inner seams 112 may substantially make contact and/or be in close proximity to one another so that the aperture 106 appears closed. As such, it will be appreciated that the aperture 106 may be defined as a slit disposed through the top of the cover 104 and between the closely parallelly-arranged cushions 102. However, in other embodiments, the aperture 106 may comprise a larger opening and further comprise a circular, rectangular, triangular, and/or any other shape. As stated, the cushions 102 are pliable, such that the cushions 102 may be manipulated, moved, and/or at least partially separated to selectively enlarge the aperture 106 from the substantially closed, resting position of the aperture 106. Accordingly, the aperture 106 may be selectively adjustable, movable, and/or stretchable. Furthermore, as will be described in more detail later herein, the aperture 106 may be configured to receive an object 300 through the aperture 106, such that the object 300 is disposed between the cushions 102 and extends from the aperture 106. Therefore, it will be appreciated that the shape and/or size of the aperture 106 may selectively conform to an object 300 disposed between the cushions 102 and within the aperture 106, since the cushions 102 are biased towards the closed position.

The cover 104 may generally extend from the inner seams 112 and/or aperture 106 over the cushions 102 to outer attachment points 113. The cover 104 may generally conform to the shape and/or profile of the cushions 102 between the inner seams 112 and the outer attachment points 113. The outer attachment points 113 may comprise seams substantially similar to the inner seams 112. However, in some embodiments, the outer attachment points 113 may alternatively comprise intermittent stitching, adhesive, and/or any other attachment means. In alternative embodiments, the cushion system 100 may not comprise outer attachment points 113. In yet alternative embodiments, it will be appreciated that the cover 104 may be integrated, sewn, stitched, adhered, and/or otherwise secured to each of the cushions 102 over any portion of the cushions 102 to create a unitary cushion system 100 comprising the cover 104 and the cushions 102. While the cover 104 is described as integrated with the cushions 102, it will be appreciated that the cover 104 may at least partially form a portion (e.g. outer surface, shell, and/or covering) of each of the cushions 102 to form the unitary cushion system 100.

The cover 104 generally extends from the aperture 106, the inner seams 112 and/or the outer attachment points 113 around a bottom side of the cushions 102 to an attachment system 108 of the cover 104 disposed about a bottom opening 105 of the cover 104. The attachment system 108 generally comprises a stretchable and/or adjustable filament 110 disposed through a channel 109 of the attachment system 108. In some embodiments, the stretchable and/or adjustable filament 110 may comprise an elastic band contained within the channel 109 of the attachment system 108 that may be manipulated to selectively increase and decrease the bottom opening 105 of the cover 104. In other embodiments, the filament 110 may comprise a cable, cord, line, rope, string, twine, and/or any other filament that may extend externally from the channel 109 and be manipulated to open and close and/or increase and decrease the size of the bottom opening 105 of the cover 104. Additionally, in some embodiments, the filament 110 may also be selectively tied at two ends of the filament 110 that extend from the channel 109, or alternatively, may comprise a clasp, drawstring, and/or other securing mechanism to selectively secure the size of the bottom opening 105 of the cover 104. As such, as will be described later herein, the attachment system 108 may be configured to be opened to receive a support apparatus 200 at least partially within a cover cavity 114 disposed between the cushions 102 and the bottom opening 105 and/or attachment system 108 of the cover 104 and then closed to secure the cushion system 100 to the support apparatus 200.

Figure 4:
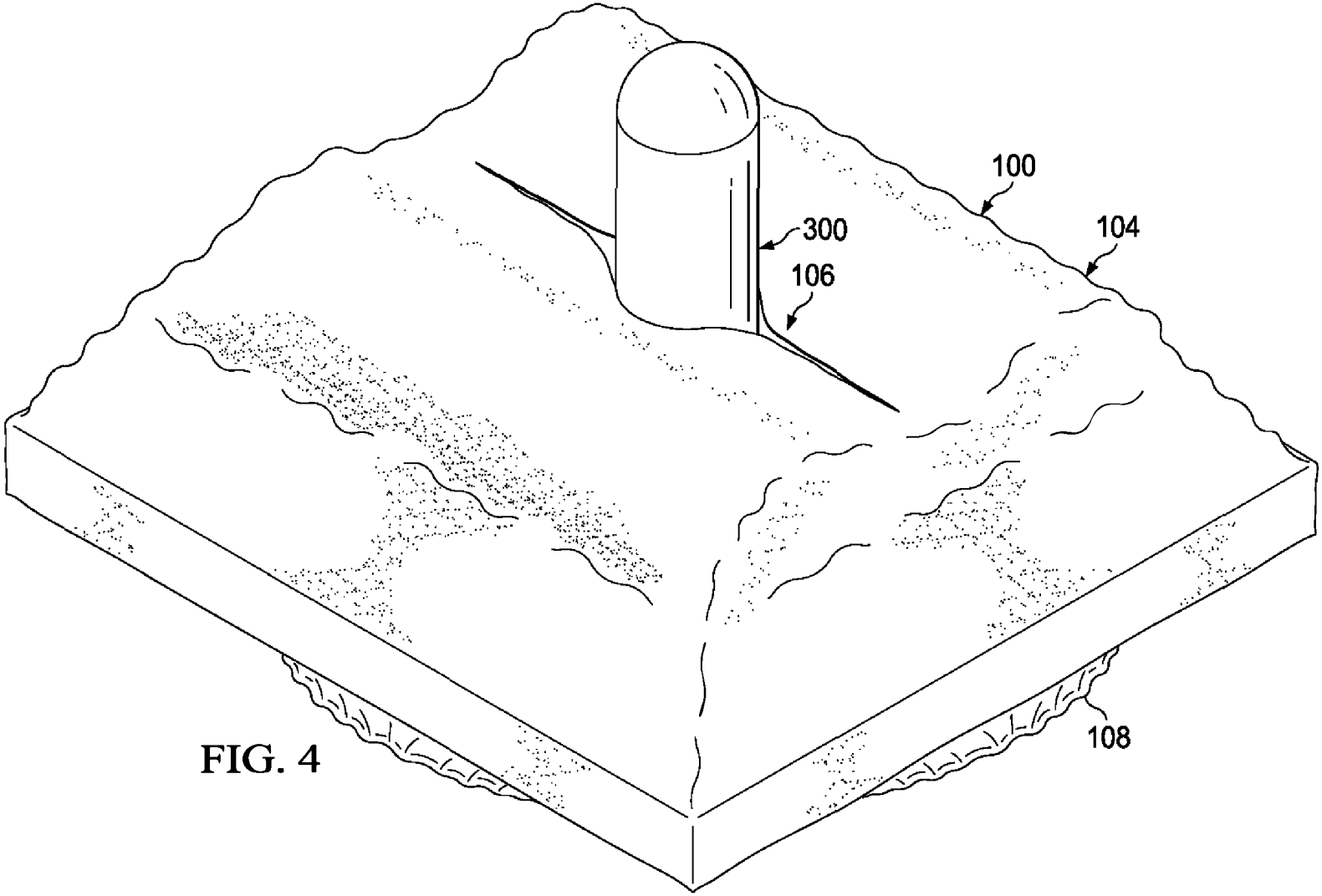
FIG. 4 is an oblique top view of the cushion system of FIGS. 1-3 secured to a support apparatus according to an embodiment of the disclosure.
Figure 5:
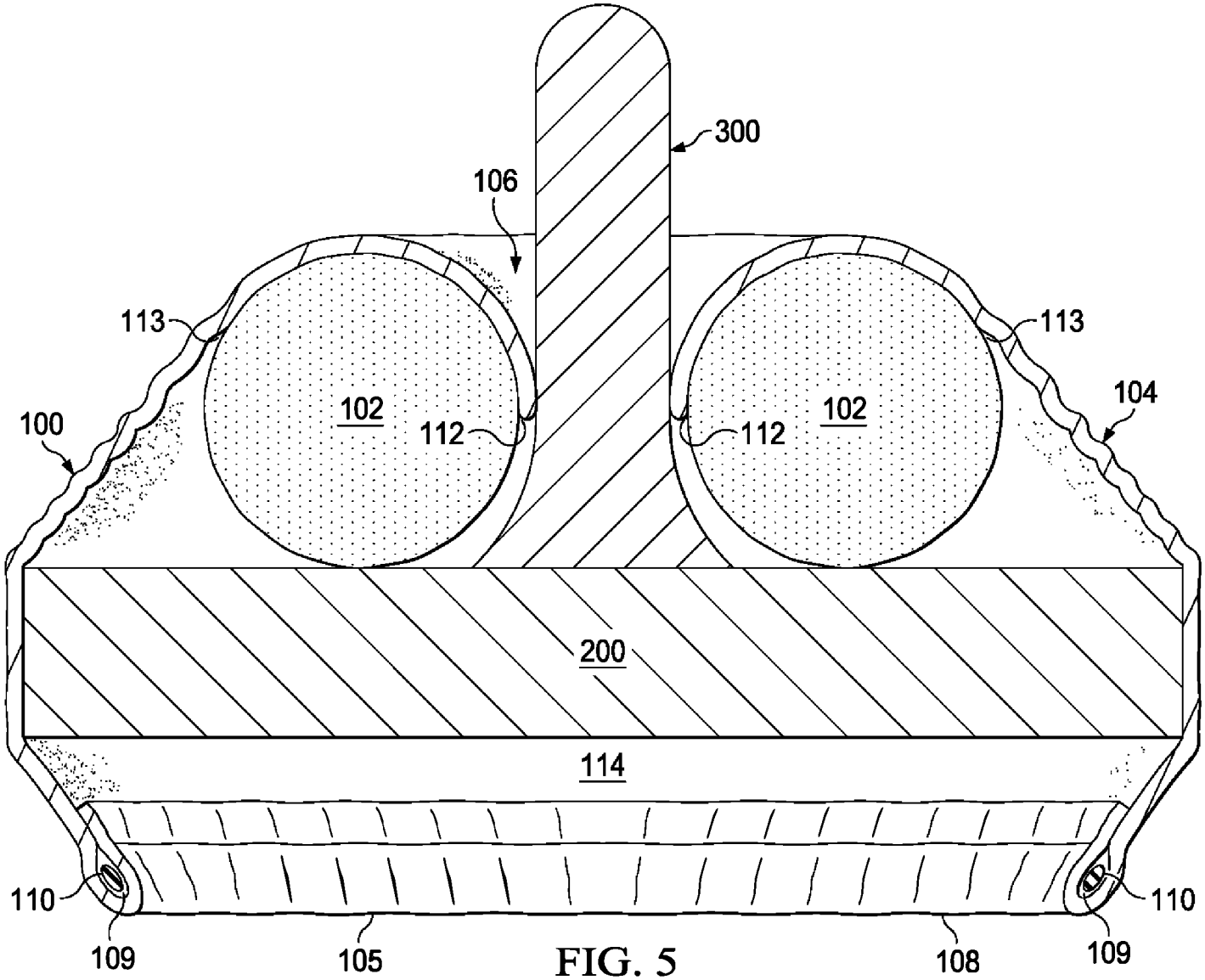
FIG. 5 is cross-sectional view of the cushion system of FIGS. 1-3 secured to the support apparatus of FIG. 4 according to an embodiment of the disclosure.

Referring now to FIGS. 4 and 5, an oblique top view and a cross-sectional view of the cushion system 100 of FIGS. 1-3 secured to a support apparatus 200 are shown, respectively, according to an embodiment of the disclosure. As stated, the attachment system 108 may be configured to fit over and receive the support apparatus 200 at least partially within the cover cavity 114 through the bottom opening 105 of the cover 104 and then closed to secure the cushion system 100 to the support apparatus 200. Closing the attachment system 108 may be accomplished by relieving tension applied to an elastic filament 110 and/or applying pressure to the filament 110 to contract the bottom opening 105 and securing the position of the filament 110 by tying loose ends of the filament and/or securing the filament 110 with a securing mechanism (e.g. clasp or drawstring) to reduce the bottom opening 105 to a size smaller than a perimeter of the support apparatus 200. When secured to the support apparatus 200, the cushions 102 may contact a top surface of the support apparatus 200 and be supported by the support apparatus 200. The support apparatus 200 may generally comprise an application specific support apparatus 200 such as a wooden, metal, and/or rigid foam structure. In some embodiments, the support apparatus 200 may be large enough to provide additional cushion on a top and/or bottom surface of the support apparatus 200 beyond the cushions 102. Thus, the support apparatus 200 may comprise a padded support apparatus 200 to provide ergonomic support and/or cushion for a user of the cushion system 100. Further, in some embodiments, the support apparatus 200 may comprise a book, box, chair, mat, seat, stool, table, and/or any other apparatus that the cover 104 may receive within the cover cavity 114.

The cushion system 100 may generally be selectively removable from the support apparatus 200 by operating the attachment system 108 to release tension of the filament 110 and open and/or increase the size of the bottom opening 105 of the cover 104, whereby the cushion system 100 may be removed from the support apparatus 200 by passing the support apparatus 200 through the bottom opening 105 of the cover 104 of the cushion system 100. Accordingly, the cushion system 100 may be transportable and selectively removed from and secured to a plurality of various support apparatuses 200. Furthermore, while support apparatus 200 is depicted as having a substantially flat upper surface, the cushion system 100 is configured to be attached and/or secured to a support apparatus 200 having a flat, concave, convex, round, smooth, rough, and/or variable-profile upper surface. Furthermore, it will be appreciated that the cushion system 100 may be attached and/or secured to various support apparatuses 200 of various sizes. Still further, the cushion system 100 may also be manufactured in different sizes (e.g. small, medium, large) and/or shapes (e.g. round, rectangular, triangular) to fit over a range of specific support apparatuses 200 for different applications.

When secured to the support apparatus 200, the cushion system 100 may also be configured to receive an object 300 through the aperture 106 of the cushion system 100. The cushion system 100 may generally be separate from each of the support apparatus 200 and the object 300. However, the object 300 may be secured to the support apparatus 200. In some embodiments, the object 300 may be secured to the support apparatus 200 by a suction cup and/or a plurality of suction cups. However, in other embodiments, the object 300 may be secured to the support apparatus 200 by an adhesive, at least one fastener (e.g. screw), and/or any other securing mechanism. In some embodiments, the object 300 may be an artificial phallus and/or other massaging, stimulating, and/or vibrating device. However, in other embodiments, the object 300 may be a pressure point device, such as a ball or other device used to apply pressure to a muscle or other body part of a user. Collectively, the cushion system 100, the support apparatus 200, and the object 300 may be referred to as a cushion system assembly.

The cushion system 100 may generally be configured to receive various objects 300 through the aperture 106 of the cushion system 100. Accordingly, the cushions 102 may generally be pliable, such that the cushions 102 may be moved and/or at least partially separated to selectively enlarge the aperture 106 from the substantially closed, resting position of the aperture 106 to receive an object 300 and/or objects 300 through the aperture 106 when the cushion system 100 is applied to and/or placed over a support apparatus 200. After the object 300 is received through the aperture 106, the cushions 102 may return as close to possible to the resting position, such that the cushions 102 may contact a periphery of the object 300 and fit securely about the object 300. Accordingly, it will be appreciated that the aperture 106 may be smaller than object 300. However, the object 300 may at least partially separate the cushions 102 where the object 300 extends through the aperture 106 and between the cushions 102. Due to the pliable nature of the cushions 102 and/or the cover 104, the cushion system 100 may be configured to accept and/or receive various sized objects 300 and/or multiple objects 300. Thus, the cushion system 100 may be used for various sized and/or shaped objects 300 and is not limited to one size and/or shaped object 300.

Figure 6:
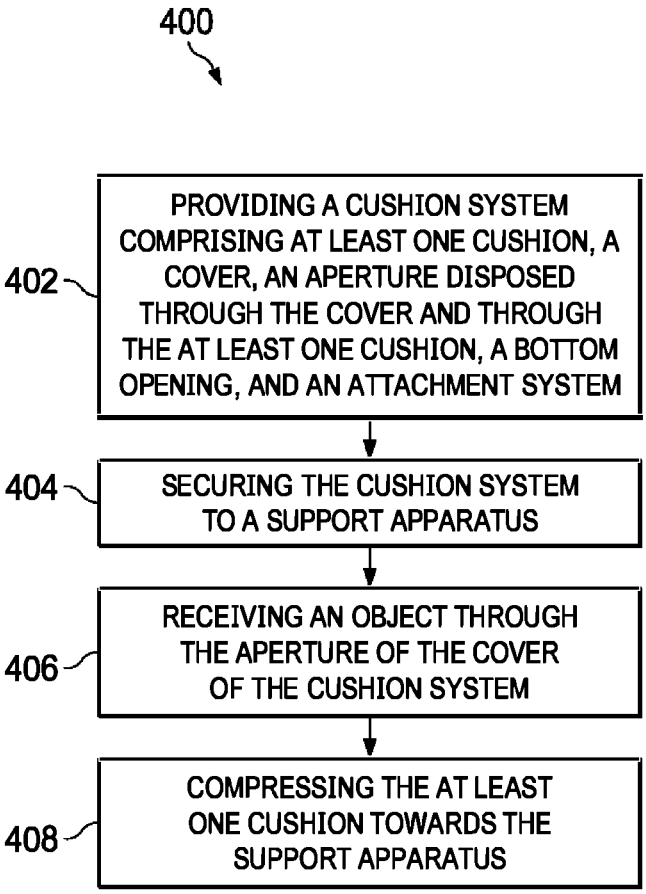
FIG. 6 is a flowchart of a method of operating the support cushion of FIGS. 1-5 according to an embodiment of the disclosure.

Referring now to FIG. 6, a flowchart of a method 400 of operating the cushion system 100 of FIGS. 1-5 is shown according to an embodiment of the disclosure. The method 400 may begin at block 402 by providing a cushion system 100 comprising at least one cushion 102, a cover 104, an aperture 106 disposed through the cover 104 and through the at least cushion 102, a bottom opening 105 in the cover 104, and an attachment system 108. The method 400 may continue at block 404 by securing the cushion system 100 to a support apparatus 200. This may be accomplished by receiving the support apparatus 200 through the bottom opening 105 of the cover 104 of the cushion system 100, positioning the cushion system 100 such that the at least one cushion 102 of the cushion system 100 contacts and/or is supported by a top surface of the support apparatus 200, and manipulating the attachment system 108 to close and/or substantially reduce the size of the bottom opening 105 of the cover 104 such that the tension present in the attachment system 108 retains the cushion system 100 on the support apparatus 200. The method 400 may continue at block 406 by receiving an object 300 through the aperture 106 of the cover 104 of the cushion system 100. This may be accomplished by securing the object 300 to the support apparatus 200 before, after, and/or simultaneously with the securing the cushion system 100 to the support apparatus 200. The method 400 may conclude at block 408 by compressing the at least one cushion 102 towards the support apparatus 200. This may be accomplished when at least one user lays, sits, or is positioned on the cushions 102 of the cushion system 100.

At least one embodiment is disclosed, and variations, combinations, and/or modifications of the embodiment(s) and/or features of the embodiment(s) made by a person having ordinary skill in the art are within the scope of this disclosure. Alternative embodiments that result from combining, integrating, and/or omitting features of the embodiment(s) are also within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 95 percent, 98 percent, 99 percent, or 100 percent. Moreover, any numerical range defined by two R numbers as defined in the above is also specifically disclosed.

Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention. Also, the phrases "at least one of A, B, and C" and "A and/or B and/or C" should each be interpreted to include only A, only B, only C, or any combination of A, B, and C.

What is claimed is:

1. A cushion system, comprising:

a plurality of cushions comprising two closely parallelly arranged, cylindrically shaped cushions;

a cover attached to the plurality of cushions;

an aperture disposed through a top of the cover, between the plurality of cushions, and through a bottom opening of the cover; and an attachment system disposed about the bottom opening of the cover for securing the cushion system to a support apparatus for use thereon.

2. The cushion system of claim 1, wherein the cushions are filled with a soft, pliable material.

3. The cushion system of claim 2, wherein the soft, pliable material comprises at least one of foam, polyester, feathers, down alternative material, memory foam, and gel.

4. The cushion system of claim 1, wherein the cover is attached at an inner seam to an inner surface of the each of the cushions.

5. The cushion system of claim 4, wherein the cover conforms to the profile of the cushions between the inner seams and outer attachment points between the cover and each of the cushions.

6. The cushion system of claim 5, wherein the cover at least partially forms a portion of each of the cushions to form a unitary cushion system.

7. The cushion system of claim 1, wherein the aperture is selectively adjustable, movable, or stretchable to receive an object through the aperture, such that the object is disposed between the cushions and extends from the aperture.

8. The cushion system of claim 7, wherein the object is secured to the support apparatus.

9. The cushion system of claim 8, wherein the attachment system is configured to receive the support apparatus at least partially within a cover cavity disposed between a bottom of the plurality of cushions and the bottom opening of the cover, and wherein the attachment system is further configured to be closed to secure the cushion system to the support apparatus.

10. The cushion system of claim 9, wherein the attachment system comprises an elastic filament disposed through a channel disposed about the bottom opening of the cover.

11. The cushion system of claim 9, wherein the attachment system comprises a filament that extends externally from a channel disposed about the bottom opening of the cover, and can be manipulated to open and close the bottom opening of the cover.

12. A cushion system assembly, comprising:

an object configured to be coupled to a support apparatus; and a cushion system, comprising:

at least one of a single cushion and two closely, parallelly arranged cushions;

a cover attached to the single cushion or the two closely, parallelly arranged cushions an aperture disposed through a top and bottom opening of the cover and configured to receive the object therethrough, wherein the single cushion comprises the aperture disposed through a middle of the cushion, wherein the two closely, parallelly arranged cushions comprises the aperture disposed between the cushions, and wherein the aperture is selectively adjustable, movable, or stretchable to receive the object through the aperture, such that the object extends from the aperture; and an attachment system disposed about the bottom opening of the cover for securing the cushion system to the support apparatus for use thereon, wherein the attachment system is configured to receive the support apparatus at least partially within a cover cavity disposed between a bottom of the single cushion or the two closely, parallelly arranged cushions and the bottom opening of the cover, wherein the attachment system is further configured to be closed to secure the cushion system to the support apparatus, and wherein the attachment system comprises at least one of an elastic filament disposed through a channel disposed about the bottom opening of the cover and a filament that extends externally from the channel, and can be manipulated to open and close the bottom opening of the cover.

13. The cushion system assembly of claim 12, wherein the aperture comprises at least one of a slit and a circular, rectangular, or triangular opening.

14. The cushion system assembly of claim 13, wherein the support apparatus comprises a book, box, chair, mat, seat, stool, or table.

15. The cushion system assembly of claim 13, wherein the object comprises a phallus.

16. A method, comprising:

providing a cushion system comprising: two closely parallelly arranged, cylindrically shaped cushions; a cover attached to the cushions; an aperture disposed through a top and bottom opening of the cover and between the cushions; and an attachment system disposed about the bottom opening of the cover for securing the cushion system to a support apparatus for use thereon;

receiving an object through the aperture;

securing the cushion system to a support apparatus; and compressing at least one of the cushions towards the support apparatus.

17. The method of claim 16, wherein the securing the cushion system to the support apparatus is accomplished by receiving the support apparatus through the bottom opening of the cover, positioning the cushion system such that at least one of the cushions contacts the support apparatus, and manipulating the attachment system to reduce a size of the bottom opening of the cover such that tension present in the attachment system retains the cushion system on the support apparatus.

18. The method of claim 17, wherein compressing at least one of the cushions towards the support apparatus is accomplished when at least one user is positioned on the cushion system.

* * * * *